United States Patent [19]

Hoet

[11] Patent Number: 4,488,086

[45] Date of Patent: Dec. 11, 1984

[54] METHOD FOR THE MANUFACTURE OF A DEVICE ENSURING AN ELECTRICAL AND THERMAL CONTACT BETWEEN A PLURALITY OF METAL SURFACES, DEVICE OBTAINED BY THIS METHOD, AND USE OF SAID DEVICE

[75] Inventor: Roger Hoet, Paris, France

[73] Assignee: Thomson-CSF, Paris, France

[21] Appl. No.: 462,106

[22] Filed: Jan. 28, 1983

Related U.S. Application Data

[63] Continuation of Ser. No. 115,023, Jan. 24, 1980, abandoned.

[30] Foreign Application Priority Data

Jan. 30, 1979 [FR] France ..... 79 02282

[51] Int. Cl.[3] ..... H01J 7/46; H01J 19/80

[52] U.S. Cl. ..... 315/39; 315/5.46; 315/5.48; 333/224; 333/232

[58] Field of Search ..... 315/5.46, 5.47, 5.48, 315/39; 333/224, 225, 226, 232, 233

[56] References Cited

U.S. PATENT DOCUMENTS

| | | | |
|---|---|---|---|
| 2,379,047 | 6/1945 | Thomas | 333/225 |
| 3,614,518 | 10/1971 | Schmidt | 315/5.46 |
| 3,940,721 | 2/1976 | Kojima | 315/5.46 |

*Primary Examiner*—Saxfield Chatmon
*Attorney, Agent, or Firm*—Roland Plottel

[57] ABSTRACT

The method according to the invention comprises winding a metal wire substantially helically both round a fitting constituted by a flexible strip and around two rods arranged parallel to the fitting axis and on either side of the fitting. The rods are eliminated when the metal wire is wound. The fitting comprises means limiting the displacement of the wire in accordance with the fitting axis, which coincides with the axis of the helix according to which the wire is found. These means are constituted by two rows of slots made in the lengthwise direction on two opposite edges of the strip constituting the fitting.

31 Claims, 19 Drawing Figures

FIG_2-a

FIG_2-c

FIG_2-d

FIG_2-e

FIG_2-f

METHOD FOR THE MANUFACTURE OF A DEVICE ENSURING AN ELECTRICAL AND THERMAL CONTACT BETWEEN A PLURALITY OF METAL SURFACES, DEVICE OBTAINED BY THIS METHOD, AND USE OF SAID DEVICE

This application is a continuation of application Ser. No. 115,023, filed 1/24/80, now abandoned.

BACKGROUND OF THE INVENTION

The present invention relates to a method for the manufacture of a device ensuring an electrical and thermal contact between a plurality of metal surfaces. It also relates to the device obtained by this method and the use of said device, particularly in the microwaves field.

It is known from the prior art to provide an electrical and thermal contact between two metal surfaces, which can for example be the surfaces of two coaxial cylinders constituting two connections of a microwave electronic tube of coaxial geometry, such as power tetrodes and triodes, using flexible strips. These strips are cut from sheets of a metal having a coefficient of elasticity, followed by bending and optionally thermal treatment. This is for example the case when using beryllium bronze strips, whose elasticity is increased by the heat treatment. These strips are then welded to one of the surfaces, generally in a groove hollowed out of said surface and which serves to retain the weld. The other surface is then placed in contact with the strips, so that an electrical and thermal contact is produced between the two metal surfaces.

However, contact by flexible strips has numerous disadvantages and reference is made to certain of these below:

The large contact surface between each strip and the facing surface and the displacement of the contact points from one strip to the next, which can lead to the creation of electrical arcs between the strips.

The fragility of these strips which are damaged if subject to sliding orthogonal to their bending direction and which consequently do not make it possible to obtain a contact between two surfaces subject both to rotary and translation movements.

Manufacturing difficulties, because it is necessary to take numerous precautions when welding the strips in order to ensure that they do not lose their elasticity and their protective coating.

Its too compact structure (the strips generally have a width of two to three millimeters and are only separated by a gap of approximately one millimeter), so that the ventilation of the contact is difficult and requires the use of very powerful fans.

It is also known from the prior art to provide an electrical and thermal contact between two metal surfaces by using a spring positioned in a groove hollowed out of one of the surfaces and held at the bottom of the groove by an elastic link. The other surface is then brought into contact with the spring, so that an electrical and thermal contact is provided between the two metal surfaces.

Compared with contact by flexible strips contact by a spring has the advantage of being punctiform and not requiring welding and in addition its ventilation is easy, because it is formed from wire and not metal sheets. However, contact by a spring has the serious disadvantage of its fragility. Thus, it is easily damaged, particularly during its installation and the turns do not remain uniformly spaced. Thus, like contact by flexible strips contact by spring does not make it possible to bring about a contact between two surfaces subject both to rotary and translation movements.

BRIEF SUMMARY OF THE INVENTION

The present invention therefore relates to a method for the manufacture of a device ensuring an electrical and thermal contact between a plurality of metal surfaces, which comprises winding at least one metal wire, substantially helically around a fitting which comprises means limiting the displacement of the wire in accordance with the axis of the fitting, which coincides with the axis of the helix about which the wire is wound, the various metal surfaces being in contact with the metal wire.

The device ensuring an electrical and thermal contact between a plurality of metal surfaces obtained by this method has, according to the invention, like contact by spring known from the prior art, the advantage of being punctiform, of not necessitating welding and of being easy to ventilate. Compared with contact by spring the device according to the invention also has the essential advantage of not being easily deformable because the means which limit the displacement of the wire in accordance with the axis of the fitting maintain a substantially uniform spacing between the turns. The device according to the invention can therefore easily be used for realising the contact between a plurality of metal surfaces subject both to rotary and translation movements.

BRIEF DESCRIPTION OF THE DRAWINGS

The invention is described in greater detail hereinafter relative to non-limitative embodiments and with reference to the attached drawings, wherein show.

Figure 1:
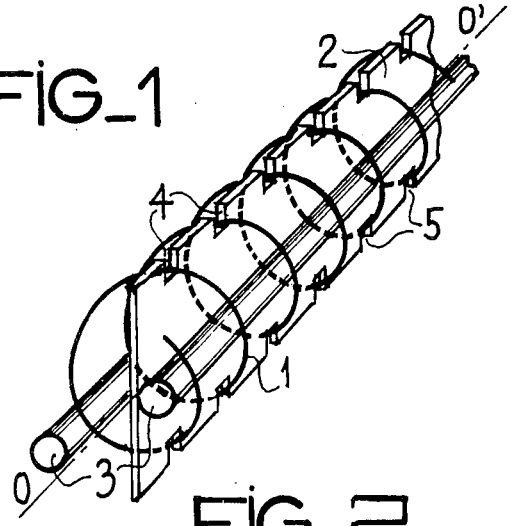
FIG. 1 a perspective view illustrating the manufacturing method according to the invention of a device ensuring an electrical and thermal contact between a plurality of metal surfaces.
Figure 2:
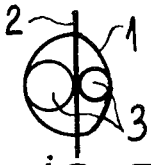
Figure 2B:
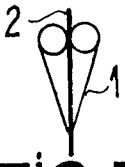
Figure 2B:
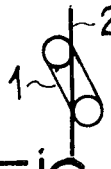
Figure 2B:
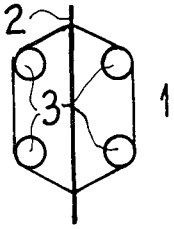
Figure 2B:
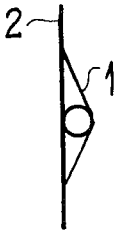
Figure 2B:
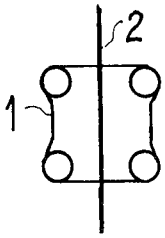

FIGS. *2a, b, c, d, e* and *f* front views of devices ensuring an electrical and thermal contact between a plurality of metal surfaces illustrating different methods of applying the manufacturing method according to the invention.

FIGS. 3, 4, 5 and 6 front and perspective views of different embodiments of devices ensuring an electrical and thermal contact between a plurality of metal surfaces obtained by the manufacturing method according to the invention.

FIGS. 7 to 14 examples of using a device ensuring an electrical and thermal contact between a plurality of metal surfaces obtained by the manufacturing method according to the invention.

DETAILED DESCRIPTION OF THE PREFERRED EMBODIMENTS

In the various drawings the same reference numerals designate the same components but, for reasons of clarity, the dimensions and proportions of the different components have not been respected.

FIG. 1 is a perspective view, illustrating the manufacturing method according to the invention of a device ensuring an electrical and thermal contact between a plurality of metal surfaces. A metal wire 1 is wound substantially helically around a fitting 2, which has means limiting the displacement of the wire in accordance with the axis of the fitting 00', which coincides with the helical axis in accordance with which the wire is wound and about two rods 3 arranged parallel to the fitting axis 00'.

In FIG. 1 the fitting is constituted by a flexible strip and the means limiting the displacement of the wire in accordance with the fitting are constituted by two rows of slots 4 and 5 made in the lengthwise direction on two opposite edges of the flexible strip constituting the fitting. The metal wire 1 is introduced into the slots. The slots of the two rows 4 and 5 may face one another in the manner shown in FIG. 1, but also they may not.

The various metal surfaces between which the device according to the invention ensures an electrical and thermal contact are not shown in FIGS. 1 to 6. These surfaces are obviously in contact with metal wire 1.

FIGS. *2a, b, c, d, e* and *f* show front views of devices ensuring an electrical and thermal contact between a plurality of metal surfaces and illustrate various ways in which the manufacturing method according to the invention can be applied. In these drawings the rods 3, as in FIG. 1, are arranged parallel to the fitting axis 00', but their number, size and positions vary.

In FIG. *2a* two rods 3, of different sizes, are arranged symmetrically on either side of the fitting, so that the device obtained is asymmetrical.

In FIG. *2b* two identical rods are arranged symmetrically on either side of the fitting and at one of the ends of the fitting, so that the device obtained is substantially triangular.

In FIG. *2c* two identical rods are arranged on either side of the fitting, but at different levels, so that the device obtained is inclined.

In FIG. *2d* four identical rods are arranged on either side of the fitting. The rods occupy in pairs symmetrical positions with respect to the fitting and the device is hexagonal.

In FIG. *2e* only one rod is used.

In FIG. *2f*, like in FIG. *2d*, four identical rods are used and are distributed on either side of the fitting. The rods, in pairs, are positioned symmetrically with respect to the fitting and each group of two rods is positioned at one end of the fitting. The device obtained is consequently substantially rectangular. It can also be subjected to a thermal or mechanical treatment, which gives it a substantially bobbin-like configuration, as shown in FIG. *2f*.

The method according to the invention is applicable no matter how many rods 3 are provided. It is also applicable when the wire is only wound around fitting 2, i.e. when no rod is used.

Figure 3:
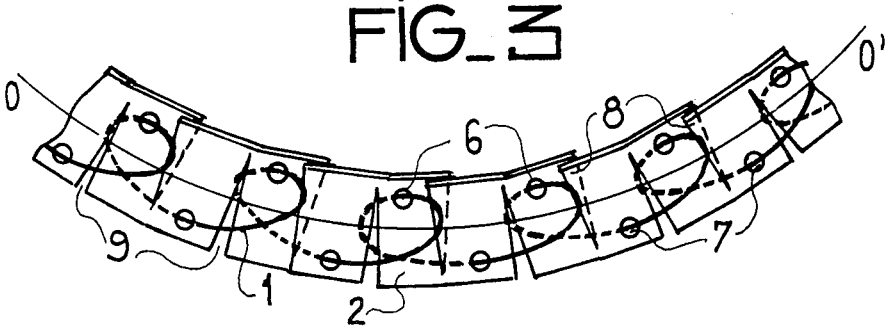

FIG. 3 is a front view of an embodiment of a device ensuring an electrical and thermal contact between a plurality of metal surfaces obtained by the method according to the invention.

In FIG. 3, as in FIG. 1, fitting 2 is constituted by a flexible strip, but the fitting shown in FIG. 3 has in the lengthwise direction and on two opposite edges two rows of slots 8 and 9, perpendicular to the fitting axis 00'. The slots of the two rows 8 and 9 alternate over the fitting.

The device according to FIG. 3 can be used flat in the form of a disc, whereby the slots of one of the rows, row 8 in FIG. 3, overlap, whilst the slots of the other row, row 9 in FIG. 3, are spaced, whereas the device shown in FIG. 1 can only be used wound around a cylinder or in the form of a rectangular strip.

In FIG. 3 the means limiting the displacement of the wire in accordance with the fitting axis are constituted by two rows of orifices 6, 7 made in the plate constituting the fitting 2 in the longitudinal direction. Metal wire 1 is introduced into these orifices.

Figure 4:
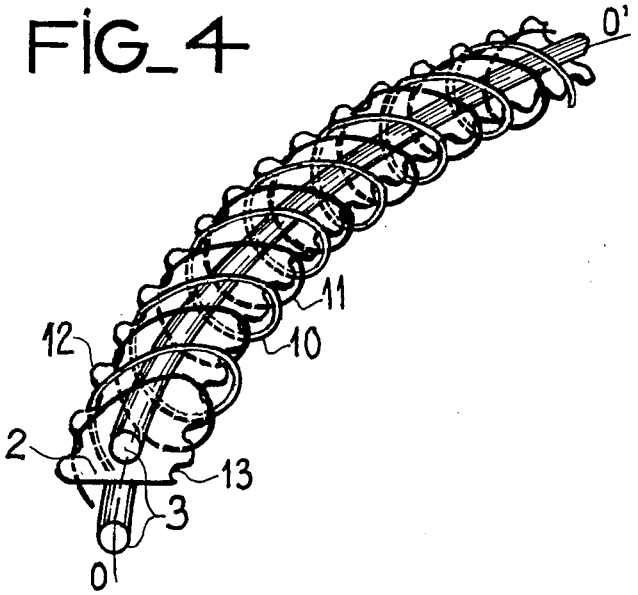

FIG. 4 is a perspective view of an embodiment of a device ensuring an electrical and thermal contact between a plurality of metal surfaces obtained by the method of the invention.

In FIG. 4 the fitting 2 comprises a sheet cut into the shape of a ring. Two rods 3 are arranged on either side of the fitting, said rods also having a ring-like configuration and are made from a plastics material or any other material which can be dissolved after winding.

In FIG. 4 the means limiting the displacement of the wire in accordance with the fitting axis 00' are constituted by undulations 12 made on two opposite edges of the plate constituting the fitting and in accordance with the fitting axis 00'. The metal wire is introduced into the concavities 13 of the undulations. In FIG. 4 two metal wires 10, 11 are wound helically and identically and alternate on the fitting. A random number of metal wires can be used.

Figure 5:
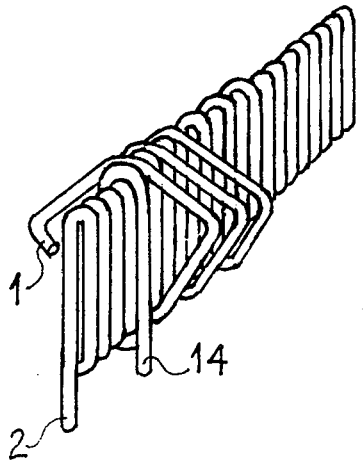

FIG. 5 is a perspective view of another embodiment of the device ensuring an electrical and thermal contact between a plurality of metal surfaces obtained by the method according to the invention. Fitting 2 comprises a substantially helically wound wire with contiguous turns. The means limiting the displacement of the wire in accordance with the fitting axis 00' are constituted by a wire wound onto the fitting substantially in the form of a helix 14, with non-contiguous turns. The helixes of the fitting and the means limiting the displacement of the wire can be flattened in order to limit the widthwise dimension of the device. The metal wire 1 ensuring the electrical contact between a plurality of metal surfaces is inserted into the space between two consecutive, non-contiguous turns of helix 14 constituting the means limiting the displacement of the wire.

Figure 6:
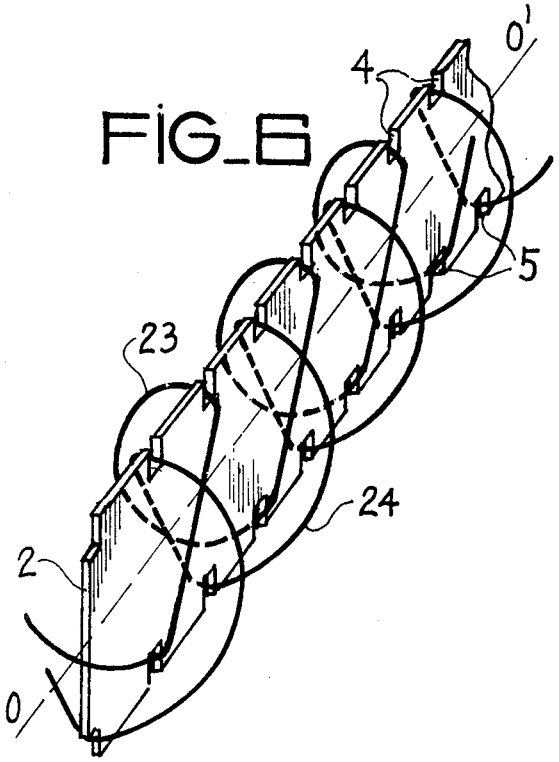

FIG. 6 shows another embodiment of a device ensuring an electrical and thermal contact between a plurality of metal surfaces obtained by the method according to the invention.

A metal wire 23 is wound substantially helically both round fitting 2, which in this embodiment is constituted by a flexible strip and about at least one first rod arranged parallel to the fitting axis 00', which is not shown in the drawing. Another metal wire 24 is then wound substantially helically both around fitting 2 and at least one second rod arranged parallel to the fitting axis and on the other side of the fitting with respect to the first rod. The device obtained has greater stability and prevents deformations received by the metal wire on one side of the fitting from being transmitted to the metal wire on the other side thereof.

The device ensuring an electrical and thermal contact obtained by the method of the invention is used in numerous applications and particularly in the microwave field.

Thus, said device is used in microwave electronic tubes having a coaxial geometry, such as power tetrodes and triodes, as used in radio and television transmitters, radar systems and industrial high frequency generators for ensuring an electrical and thermal contact between the surfaces of two coaxial cylinders constituting two connections of a tube. The device can then be placed in a groove hollowed out of the surface of one of the two cylinders. It can also be fixed to the surface of one of the two cylinders either in the manner shown in FIG. 7, which is an exploded perspective view, by tongues 27 provided on surface 28 which penetrate oblong holes 29 made in fitting 2 orthogonally to axis 00′ of said fitting, or by tongues 30 cut in fitting 2, in the manner shown in FIG. 8 which is a perspective view of said fitting, said tongues 30 penetrating the holes provided on the surface of one of the two cylinders.

Figure 9:
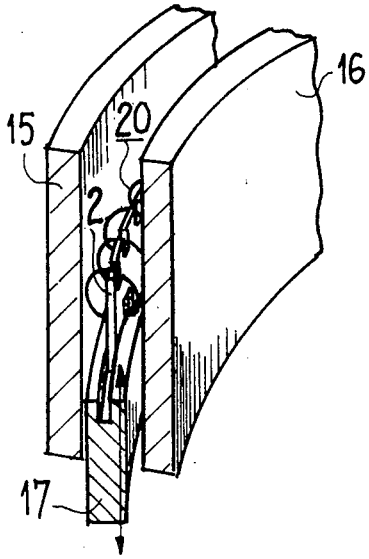

This device can be used in the manner shown in FIG. 9 to provide an electrical contact between two walls 15, 16 of a microwave coaxial cavity Device 20 then serves as a piston and is driven in translation by a control rod, in the manner shown by the double arrow in FIG. 9.

Figure 10:
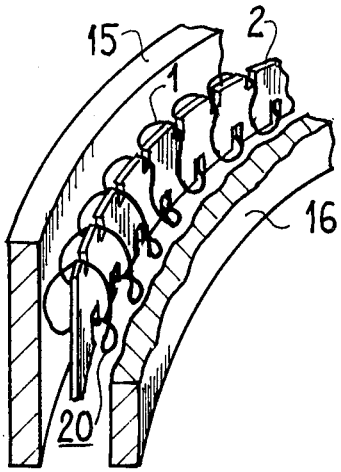

In order that device 20 ensures contact between walls 15 and 16 no matter what the diameter variations of said walls and their offsetting it is either necessary to fit device 20 by forcing the turns of the helix by which wire 1 is wound to assume a herring-bone configuration relative to fitting 2, as shown in FIG. 10 which is a plan view of device 20 ensuring an electrical contact between walls 15 and 16 of a microwave coaxial cavity and which is shown in perspective view in FIG. 9, or use a device such as that shown in FIG. 6, which is constructed in two stages and which has a great versatility of use.

Figure 11:
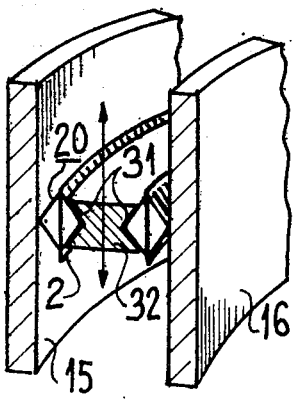

To provide an electrical contact between two walls 15 and 16 of a microwave coaxial cavity it is also possible to use in the manner shown in FIG. 11, which is a perspective view, two devices 20 obtained by the method according to the invention and fitted into two grooves 31 located on either side of a piston 32. The devices 20 are connected to the piston by their fitting 2. For housing devices 20 it is possible to use rectangular or triangular grooves 31 in the manner shown in FIG. 11. The triangular-shaped grooves have the advantage, when the devices 20 are substantially lozenge-shaped as shown in FIG. 11, of permitting a very good ventilation of the contacts due to the space between each device 20 and piston 32. Moreover with triangular grooves the devices 20 are in contact with two sides of the grooves and thus follow even the smallest displacements of piston 32, which is not the case for rectangular grooves with which it is difficult to obtain a fine setting of the piston position because the devices 20 do not ensure a good contact with the piston, particularly in view of the fact that it is necessary to provide a clearance between the fitting and the piston to enable the fitting to freely change dimensions. As shown by the double arrow in FIG. 11 the piston is obviously movable in translation.

Figure 12:
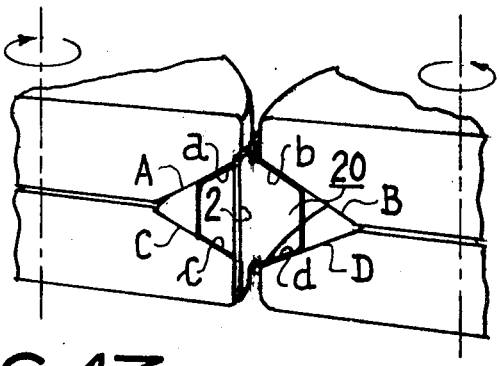

The device obtained by the method according to the invention can be used for obtaining an electrical and thermal contact between a plurality of metal surfaces, e.g. four such surfaces, for the substantially hexagonal device shown in front view in FIG. 12.

The four surfaces A, B, C and D engage on the sides a, b, c, d of the hexagon, whereby said surfaces A, B, C and D may or may not be rotated.

Figure 13:
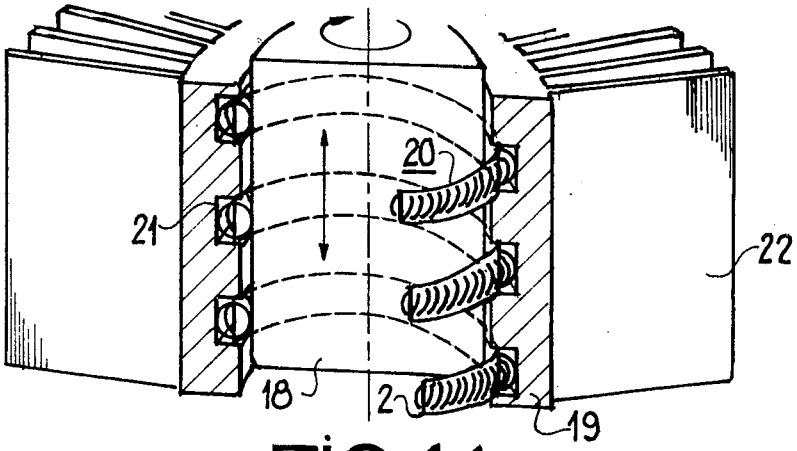

The device obtained by the method according to the invention can be housed in the manner shown in FIG. 13 in a helical groove 21 provided on the surface of one of the two members between which the device 20 provides an electrical and thermal contact. Groove 21 makes it possible to increase the surface contact provided by device 20 between two members 18 and 19. In FIG. 13 member 19 has cooling ribs 22. Device 20 in FIG. 13 ensures contact between members 18 and 19, which can be subject both to rotational and translational movements.

It is also possible to make a thread within member 18. Members 18 and 19 can then be screwed to one another by means of device 20, so that the thus obtained contact is fixed.

It is also possible to superimpose a plurality of devices 20 in order to increase the contact surface obtained between a plurality of metal members.

Figure 14:
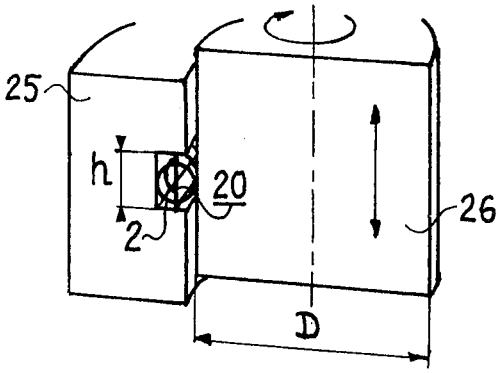

A non-limitative embodiment of the object of the invention, illustrated by FIG. 14, has given the following results:

Device 20 comprises a fitting 2 made from a flexible, 0.2 mm thick, beryllium bronze strip. The fitting of the devices according to the invention is generally metallic, which makes it possible to reduce the contact inductance between the metal wire and the fitting, however, it is pointed out that the fitting can also be made from insulating material such as polytetrafluoroethylene. A 0.33 mm diameter tungsten wire 1 is wound substantially helically onto fitting 2. Two diameter 2.5 mm, cylindrical rods are used for winding the wire and are then eliminated. Device 20 is housed in the manner shown in FIG. 14 in a groove of height h equal to 9 mm, hollowed out of a metal member 25. A piston 26 of diameter D equal to 77 mm is in contact with device 20. This piston can be displaced in rotation and translation, in the manner indicated by the arrows in FIG. 14.

A current of 200 A is established between members 25 and 26, which are made from brass. The recorded voltage drop is only 28 mV, whereas it would be at least 50 mV if the contact between the metal surfaces of members 25 and 26 was provided by prior art devices. Finally after 90 minutes operation the temperature of members 25 and 26 does not exceed 40° C., because the device according to the invention easily permits a good ventilation.

The invention is not limited to the embodiments described and represented hereinbefore and various modifications can be made thereto without passing beyond the scope of the invention.

What is claimed is:

1. In a microwave electronic device comprising, (a) at least two conductive surfaces spaced apart from each other;

(b) a substantially helical winding of at least one metal wire, each of several turns of said winding having in a plane perpendicular to the helix axis abrupt bends at two different locations and thus each of said turns having a substantially non circular shape;

(c) a fitting comprising a flexible strip coinciding with the axis of said substantially helical winding, said fitting comprising two rows of slots made on two opposite edges of the fitting and the metal wire passing in said slots, said wire having said two abrupt bends at the slots of the fitting to prevent the wire from moving relative to the fitting when said helical winding is moved relative to said surfaces;

(d) said winding and said fitting being positioned between said surfaces in touching contact therewith, and providing good electrical and thermal contact between said winding and said surfaces at different positions of said surfaces; said surfaces and said fitting with winding being adapted for relative movement therebetween; said bends and slots preventing the wire from moving and from sliding around in the fitting, and for preventing different turns of wire from touching one another when there is relative movement between said surfaces and said fitting with winding.

2. A device according to claim 1, wherein said winding is constituted by two independant metal wires, one constituting the turns which extend outward on one side of the fitting and the other constituting the turns which extend outward the other side of the fitting.

3. A device according to claim 1, wherein said flexible strip of said fitting is in the shape of a ring along its length and is flexible in a radial direction.

Figure 7:
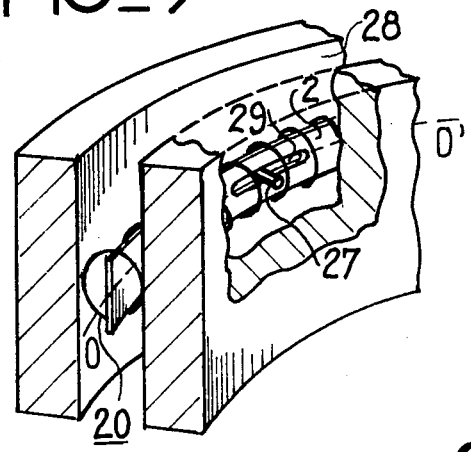
Figure 8:
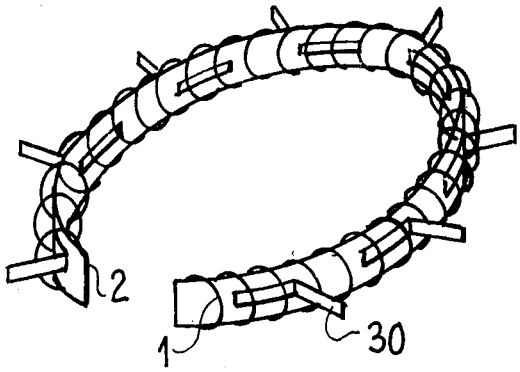

4. A device according to claim 1, wherein the fitting has fixing holes (FIGS. 7, 29).

5. A device according to claim 1, wherein the fitting has fixing tongues.

6. A device according to claim 1, wherein said device is a microwave coaxial cavity.

7. A device according to claim 6, wherein said winding and said fitting are mounted between two surfaces of the cavity in such a way that the turns of the winding are arranged in herring-bone-like manner with respect to the fitting.

8. A device according to claim 1, wherein said device is a microwave coaxial cavity (FIG. 11) and said two conductive surfaces comprise a movable piston between two fixed conductive surfaces and wherein two windings and two fittings are positioned between said pistions and said fixed surfaces, said piston having triangular grooves in its side and said windings and fittings being located in said triangular grooves.

9. A device according to claim 1, wherein said device is a microwave electronic tube having a coaxial geometry, said two conductive surfaces comprising two coaxial cylinders of said tube, said winding and fitting being positioned between and ensuring an electrical and thermal contact between said two coaxial cylinders, and said cylinders being subject to relative axial displacement and rotational movement.

10. A device according to claim 1, wherein said winding has in the plane perpendicular to the helix axis a substantially non-circular shape of a triangle, or rectangle, or hexagon, or lozenge.

11. In a microwave electronic device comprising, (a) at least two conductive surfaces spaced apart from each other;

(b) a substantially helical winding of at least one metal wire, each of several turns of said winding having in a plane perpendicular to the helix axis abrupt bends at two different locations and thus each of said turns having a substantially non circular shape;

(c) a fitting comprising a flexible strip coinciding with the axis of said substantially helical winding, said fitting comprising two rows of holes made on two opposite edges of the fitting and the metal wire passing in said holes, said wire having said two abrupt bends at the holes of the fitting to prevent the wire from moving relative to the fitting when said helical winding is moved relative to said surfaces;

(d) said winding and said fitting being positioned between said surfaces in touching contact therewith, and providing good electrical and thermal contact between said winding and said surfaces at different positions of said surfaces; said surfaces and said fitting with winding being adapted for relative movement therebetween; said bends and holes preventing the wire from moving and from sliding around in the fitting, and for preventing different turns of wire from touching one another when there is relative movement between said surfaces and said fitting with winding.

12. A device according to claim 11, wherein said winding is constituted by two independant metal wires, one constituting the turns which extend outward on one side of the fitting and the other constituting the turns which extend outward the other side of the fitting.

13. A device according to claim 11, wherein said flexible strip of said fitting is in the shape of a ring along its length and is flexible in a radial direction.

14. A device according to claim 11, wherein the fitting has fixing holes (FIGS. 7, 29).

15. A device according to claim 11, wherein the fitting has fixing tongues.

16. A device according to claim 11, wherein said device is a microwave coaxial cavity.

17. A device according to claim 16, wherein said winding and said fitting are mounted between two surfaces of the cavity in such a way that the turns of the winding are arranged in herring-bone-like manner with respect to the fitting.

18. A device according to claim 11, wherein said device is a microwave coaxial cavity (FIG. 11) and said two conductive surfaces comprise a movable piston between two fixed conductive surfaces and wherein two windings and two fittings are positioned between said pistions and said fixed surfaces, said piston having triangular grooves in its side and said windings and fittings being located in said triangular grooves.

19. A device according to claim 11, wherein said device is a microwave electronic tube having a coaxial geometry, said two conductive surfaces comprising two coaxial cylinders of said tube, said winding and fitting being positioned between and ensuring an electrical and thermal contact between said two coaxial cylinders, and said cylinders being subject to relative axial displacement and rotational movement.

20. A device according to claim 11, wherein said winding has in the plane perpendicular to the helix axis a substantially non-circular shape of a triangle, or rectangle, or hexagon, or lozenge.

21. In a microwave electronic device comprising, (a) at least two conductive surfaces spaced apart from each other;

(b) a substantially helical winding of at least one metal wire, each of several turns of said winding having in a plane perpendicular to the helix axis abrupt bends at two different locations and thus each of said turns having a substantially non circular shape;

(c) a fitting comprising a flexible strip coinciding with the axis of said substantially helical winding, said fitting comprising two rows of undulations made on two opposite edges of the fitting and the metal wire passing in concavities of said undulations, said wire having said two abrupt bends at the undulations of the fitting to prevent the wire from moving relative to the fitting when said helical winding is moved relative to said surfaces;

(d) said winding and said fitting being positioned between said surfaces in touching contact therewith, and providing good electrical and thermal contact between said winding and said surfaces at different positions of said surfaces; said surfaces and said fitting with winding being adapted for relative movement therebetween; said bends and concavities of said undulations preventing the wire from moving and from sliding around in the fitting, and for preventing different turns of wire from touching one another when there is relative movement between said surfaces and said fitting with winding.

22. A device according to claim 21, wherein said winding is constituted by two independant metal wires, one constituting the turns which extend outward on one side of the fitting and the other constituting the turns which extend outward the other side of the fitting.

23. A device according to claim 21, wherein said flexible strip of said fitting is in the shape of a ring along its length and is flexible in a radial direction.

24. A device according to claim 21, wherein said wire has non-contiguous turns.

25. A device according to claim 21, wherein the fitting has fixing holes (FIGS. 7, 29).

26. A device according to claim 21, wherein the fitting has fixing tongues.

27. A device according to claim 21, wherein said device is a microwave coaxial cavity.

28. A device according claim 27, wherein said winding and said fitting are mounted between two surfaces of the cavity in such a way that the turns of the winding are arranged in herring-bone-like manner with respect to the fitting.

29. A device according to claim 21, wherein said device is a microwave coaxial cavity (FIG. 11) and said two conductive surfaces comprise a movable piston between two fixed conductive surfaces and wherein two windings and two fittings are positioned between said pistions and said fixed surfaces, said piston having triangular grooves in its side and said windings and fittings being located in said triangular grooves.

30. A device according to claim 21, wherein said device is a microwave electronic tube having a coaxial geometry, said two conductive surfaces comprising two coaxial cylinders of said tube, said winding and fitting being positioned between and ensuring an electrical and thermal contact between said two coaxial cylinders, and said cylinders being subject to relative axial displacement and rotational movement.

31. A device according to claim 21, wherein said winding has in the plane perpendicular to the helix axis a substantially non-circular shape of a triangle, or rectangle, or hexagon, or lozenge.

* * * * *